US011566847B2

(12) United States Patent
Huang

(10) Patent No.: US 11,566,847 B2
(45) Date of Patent: Jan. 31, 2023

(54) INTEGRATED LIQUID-COOLING RADIATOR

(71) Applicant: Dongguan Hanxu Hardware Plastic Technology Co., Ltd., Guangdong (CN)

(72) Inventor: Tsung-Hsien Huang, Dongguan (CN)

(73) Assignee: DONGGUAN HANXU HARDWARE PLASTIC TECHNOLOGY CO., LTD., Guangdong (CN)

( * ) Notice: Subject to any disclaimer, the term of this patent is extended or adjusted under 35 U.S.C. 154(b) by 34 days.

(21) Appl. No.: 17/243,597

(22) Filed: Apr. 29, 2021

(65) Prior Publication Data

US 2022/0307771 A1 Sep. 29, 2022

(30) Foreign Application Priority Data

Mar. 29, 2021 (CN) ..... 202110331260.7

(51) Int. Cl.

| | |
|---|---|
| ***F28D 1/053*** | (2006.01) |
| ***F28D 15/00*** | (2006.01) |
| ***F28F 3/12*** | (2006.01) |
| *F28D 21/00* | (2006.01) |

(52) U.S. Cl.

CPC ..... *F28D 1/05375* (2013.01); *F28D 15/00* (2013.01); *F28F 3/12* (2013.01); *F28D 2021/0031* (2013.01); *F28F 2250/08* (2013.01)

(58) Field of Classification Search

CPC ..... F28D 1/05375; F28D 15/00; F28D 2021/0031; F28F 3/12; F28F 2250/08; H01L 23/473

USPC ..... 165/80.4

See application file for complete search history.

(56) References Cited

U.S. PATENT DOCUMENTS

| | | | | |
|---|---|---|---|---|
| 6,005,772 | A * | 12/1999 | Terao | F28D 15/0266 165/80.4 |
| 6,874,567 | B2 * | 4/2005 | Ohara | F28F 9/026 174/15.2 |
| 8,376,032 | B2 * | 2/2013 | Song | H01L 23/427 165/80.4 |
| 2008/0105407 | A1 * | 5/2008 | Yeh | H01L 23/467 257/E23.098 |
| 2009/0044929 | A1 * | 2/2009 | Yeh | F28D 15/00 165/104.19 |
| 2013/0299139 | A1 * | 11/2013 | Mounioloux | F28D 1/05375 165/120 |
| 2018/0195804 | A1 * | 7/2018 | Mai | F28D 15/00 |

* cited by examiner

*Primary Examiner* — Tho V Duong
(74) *Attorney, Agent, or Firm* — Leong C. Lei

(57) ABSTRACT

An integrated liquid-cooling radiator includes a first reservoir, a second reservoir and a plurality of radiating pipes. The first reservoir is made of a heat-dissipating metal material. A first partition is provided in the first reservoir to divide an inside of the first reservoir into a first liquid inlet chamber and a first liquid outlet chamber. A bottom of the first reservoir is provided with a thermally conductive copper sheet. By arranging the thermally conductive copper sheet on the first reservoir to form an integrated structure, the product has a compact structure.

10 Claims, 10 Drawing Sheets

INTEGRATED LIQUID-COOLING RADIATOR

BACKGROUND OF THE INVENTION

1. Field of the Invention

The present invention relates to a radiator, and more particularly to an integrated liquid-cooling radiator.

2. Description of the Prior Art

A water-cooling radiator is configured to dissipate the heat of the radiator using a liquid under the action of a pump. Compared with air cooling, the water-cooling radiator has the advantages of quietness, stable cooling, and less dependence on the environment. The heat dissipation performance of the water-cooling radiator is proportional to the flow rate of a cooling liquid (water or other liquid). The flow rate of the cooling liquid is related to the power of the pump in the cooling system. Moreover, the heat capacity of water is large. This makes the water-cooling system have a good heat load capacity.

A conventional water-cooling heat dissipation device usually consists of a water-cooling radiator, a water-cooling block, and a water pipe. The water pipe is connected between the water-cooling radiator and the water-cooling block. The water pipe allows water in the water-cooling radiator and the water-cooling block to circulate. After the water absorbs the heat from the water-cooling block, the water flows to the water-cooling radiator for heat dissipation, and the water after heat dissipation flows back to the water-cooling block. The water-cooling radiator and the water-cooling block of the above-mentioned water-cooling radiator assembly are arranged separately. The structure is not compact, and it is inconvenient to use. The water-cooling radiator has a reservoir. The reservoir has no water pump function, which makes the water flow in the water-cooling radiator slower and the heat dissipation efficiency is low. In addition, there is no partition in the reservoir, which makes the distance of the water flow in the water-cooling radiator shorter so that the water cannot cool and dissipate heat effectively. Therefore, it is necessary to improve the conventional water-cooling radiator.

SUMMARY OF THE INVENTION

In view of the defects of the prior art, the primary object of the present invention is to provide an integrated liquid-cooling radiator, which can effectively solve the problems that the conventional water-cooling radiator is not compact in structure, inconvenient to use, poor in heat dissipation, and unable to cool the cooling liquid and dissipate heat effectively.

In order to achieve the above object, the present invention adopts the following technical solutions:

An integrated liquid-cooling radiator comprises a first reservoir, a second reservoir, and a plurality of radiating pipes. Two ends of the radiating pipes communicate with the first reservoir and the second reservoir, respectively. Radiating fins are provided on the radiating pipes.

The first reservoir is made of a heat-dissipating metal material. A first partition is provided in the first reservoir to divide an inside of the first reservoir into a first liquid inlet chamber and a first liquid outlet chamber. A bottom of the first reservoir is formed with a first liquid inlet communicating with the first liquid inlet chamber and a first liquid outlet communicating with the first liquid outlet chamber. The bottom of the first reservoir is provided with a thermally conductive copper sheet. A liquid inlet end of the thermally conductive copper sheet is in communication with the first liquid inlet. A liquid outlet end of the thermally conductive copper sheet is in communication with the first liquid outlet.

The second reservoir is made of a heat-dissipating metal material. A second partition is provided in the second reservoir to divide an inside of the second reservoir into a second liquid inlet chamber and a second liquid outlet chamber. The second liquid inlet chamber is provided with a liquid pump chamber. The liquid pump chamber is provided with a second liquid inlet communicating with the second liquid inlet chamber and a second liquid outlet communicating with the second liquid outlet chamber. A liquid pump is provided in the liquid pump chamber.

Some of the radiating pipes are connected between the first liquid outlet chamber and the second liquid inlet chamber. The others of the radiating pipes are connected between the first liquid inlet chamber and the second liquid outlet chamber.

Compared with the prior art, the present invention has obvious advantages and beneficial effects. Specifically, it can be known from the above technical solutions:

By arranging the thermally conductive copper sheet on the first reservoir to form an integrated structure, the product has a compact structure and is more convenient to use. By providing the liquid pump in the second reservoir, the liquid pump and the second reservoir are integrated. The flow speed of the cooling liquid in the radiating pipes is effectively increased, and the heat dissipation efficiency is improved. In cooperation with the partition in each reservoir, the flow path of the cooling liquid is extended greatly, so that the cooling liquid can cool and dissipate heat effectively and sufficiently. The overall heat dissipation effect of the product is very good.

DETAILED DESCRIPTION OF THE PREFERRED EMBODIMENTS

Figure 1:
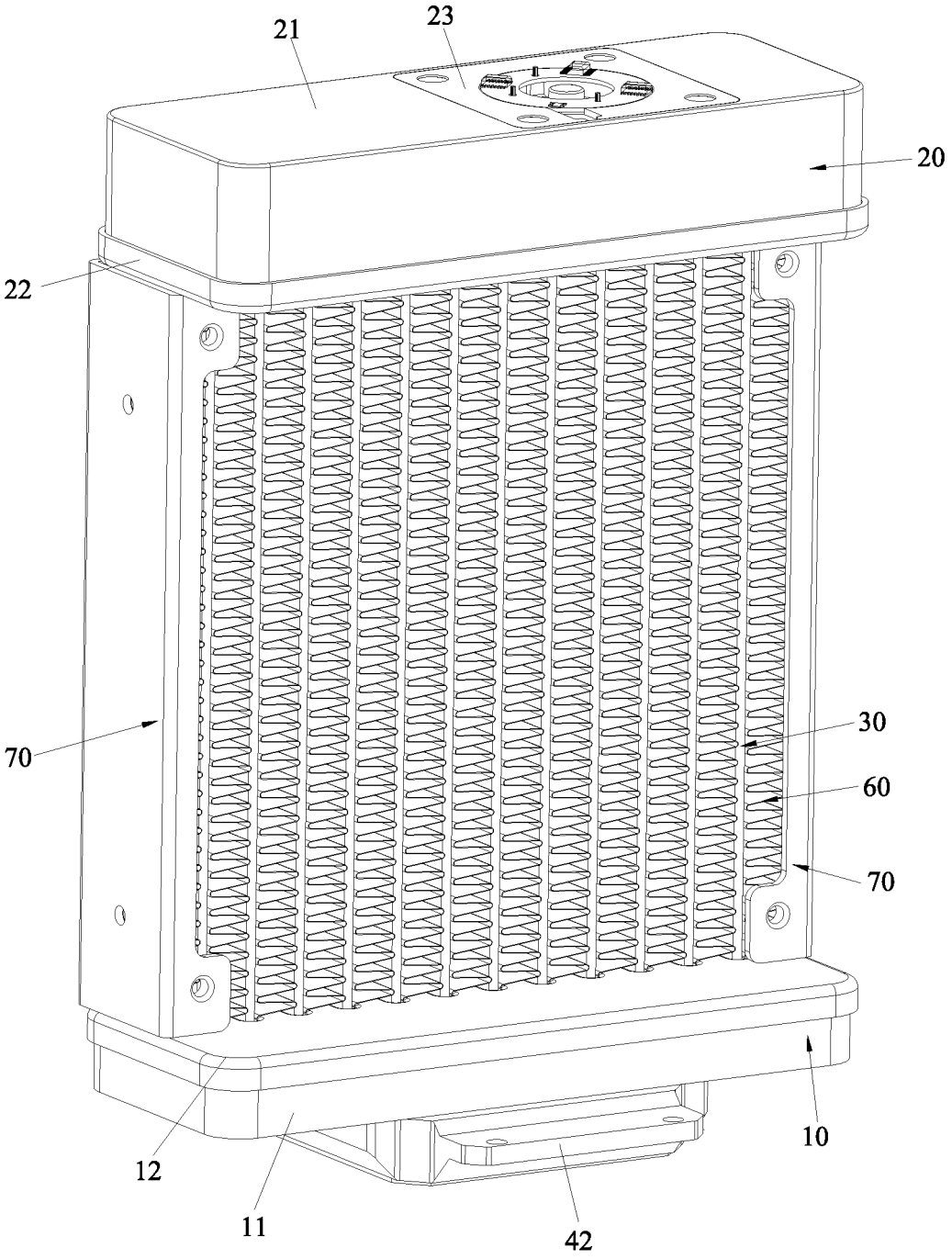
FIG. 1 is a perspective view according to a first embodiment of the present invention.
Figure 2:
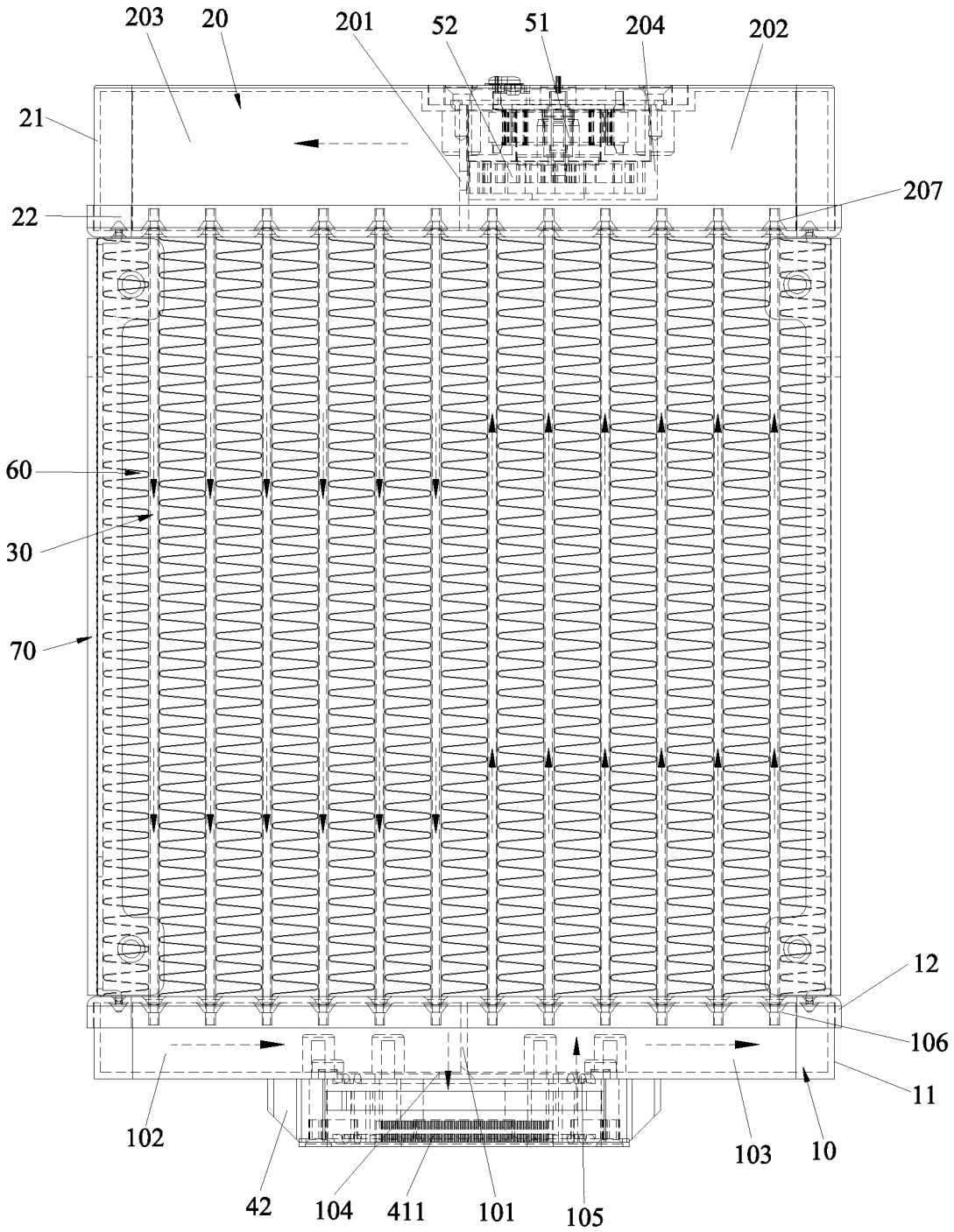
FIG. 2 is a front view according to the first embodiment of the present invention.
Figure 3:
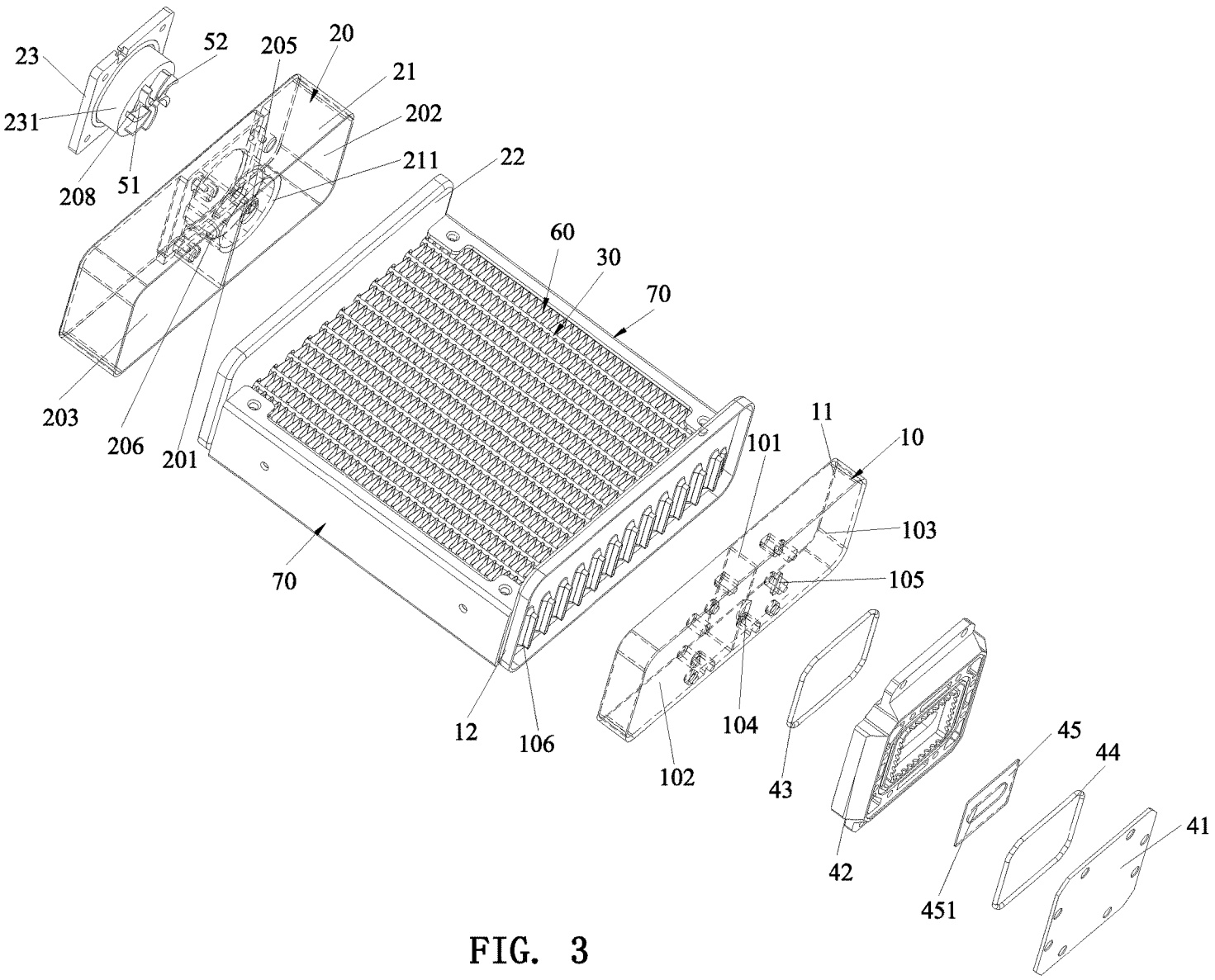
FIG. 3 is an exploded view according to the first embodiment of the present invention.
Figure 4:
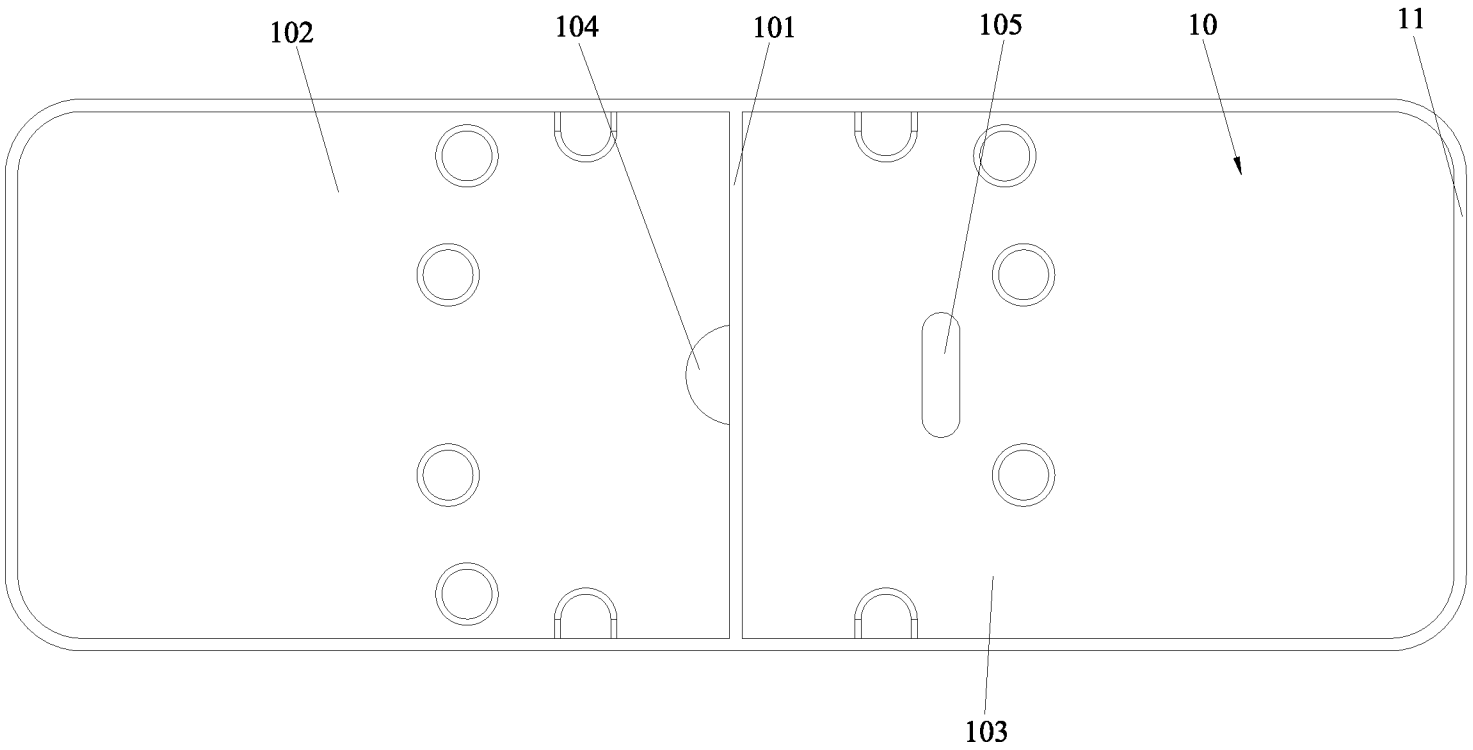
FIG. 4 is a front view of the first reservoir according to the first embodiment of the present invention.
Figure 5:
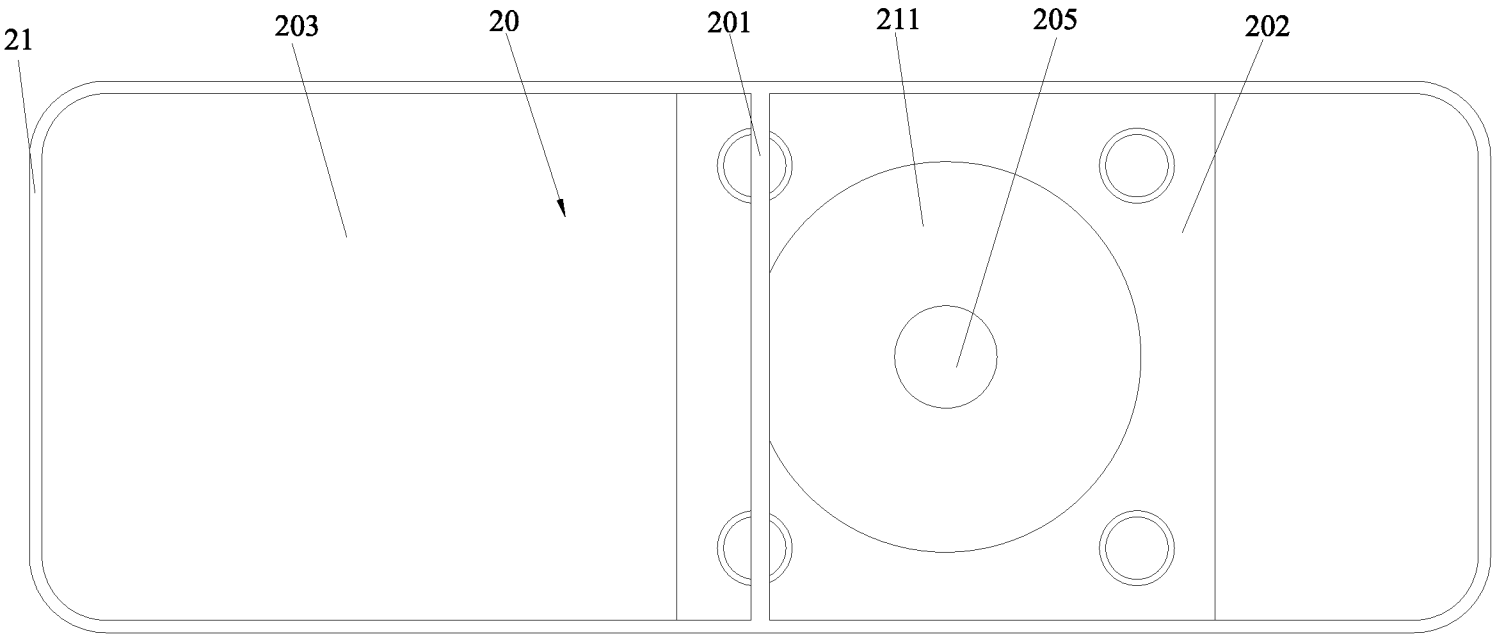
FIG. 5 is a front view of the second reservoir according to the first embodiment of the present invention.

FIGS. 1 to 5 show the specific structure of a first embodiment of the present invention, comprising a first reservoir 10, a second reservoir 20 and a plurality of radiating pipes 30.

The first reservoir 10 is made of a heat-dissipating metal material. A first partition 101 is provided in the first reservoir 10 to divide the inside of the first reservoir 10 into a first liquid inlet chamber 102 and a first liquid outlet chamber 103. The bottom of the first reservoir 10 is formed with a first liquid inlet 104 communicating with the first liquid inlet chamber 102 and a first liquid outlet 105 communicating with the first liquid outlet chamber 103. The bottom of the first reservoir 10 is provided with a thermally conductive copper sheet 41. A liquid inlet end of the thermally conductive copper sheet 41 is in communication with the first liquid inlet 104. A liquid outlet end of the thermally conductive copper sheet 41 is in communication with the first liquid outlet 105.

Specifically, the first reservoir 10 includes a first reservoir body 11 and a first reservoir cover 12. The first partition 101 is formed in the first reservoir body 11. The first liquid inlet 104 and the first liquid outlet 105 are formed on the bottom of the first reservoir body 11. The first reservoir cover 12 is hermetically fixed to the first reservoir body 11. The first reservoir cover 12 is provided with a plurality of first installation grooves 106. Some of the first installation grooves 106 communicate with the first liquid inlet chamber 102, and the others of the first installation grooves 106 communicate with the first liquid outlet chamber 103. The first reservoir body 11 and the first reservoir cover 12 are made of copper or aluminum. The first reservoir cover 12 is hermetically fixed to the first reservoir body 11 by welding. The first partition 101 is installed in the first reservoir body 11 by welding or integrally formed with the first reservoir body 11.

The thermally conductive copper sheet 41 is fixed to the bottom of the first reservoir body 11 through a fixing seat 42. A first sealing gasket 43 is sandwiched between the inner peripheral edge of the fixing seat 42 and the first reservoir body 11. The thermally conductive copper sheet 41 is fixed to the bottom of the fixing seat 42. A second sealing gasket 44 is sandwiched between the inner peripheral edge of the thermally conductive copper sheet 41 and the fixing seat 42. Fins 411 provided on the inner side of the thermally conductive copper sheet 41 are covered with a partitioning film 45. The partitioning film 45 is clamped between the fixing seat 42 and the thermally conductive copper sheet 41. The partitioning film 45 has a slot 451. The slot 451 is aligned with and communicates with the first liquid inlet 104.

The second reservoir 20 is made of a heat-dissipating metal material. A second partition 201 is provided in the second reservoir 20 to divide the inside of the second reservoir 20 into a second liquid inlet chamber 202 and a second liquid outlet chamber 203. The second liquid inlet chamber 202 is provided with a liquid pump chamber 204. The liquid pump chamber 204 is provided with a second liquid inlet 205 communicating with the second liquid inlet chamber 202 and a second liquid outlet 206 communicating with the second liquid outlet chamber 203. A liquid pump 51 is provided in the liquid pump chamber 204.

Specifically, the second reservoir 20 includes a second reservoir body 21, a second reservoir cover 22, and a liquid pump cover 23. The second partition 201 is formed in the second reservoir body 21. The second reservoir cover 22 is hermetically fixed to the second reservoir body 21. The second reservoir cover 22 is provided with a plurality of second installation grooves 207. Some of the second installation grooves 207 communicate with the second liquid inlet chamber 202, and the others of the second installation grooves 207 communicate with the second liquid outlet chamber 203. The liquid pump cover 23 is hermetically fixed to the second reservoir body 21 and configured to seal the opening of the liquid pump chamber 204. The liquid pump 51 is fixed to the inner side of the liquid pump cover 23. An impeller 52 is connected to an output shaft of the liquid pump 51. The impeller 52 is located in the liquid pump chamber 401 and is driven to rotate by the liquid pump 51. In this embodiment, the second reservoir body 21 and the second reservoir cover 22 are made of copper or aluminum. The second reservoir cover 22 is hermetically fixed to the second reservoir body 21 by welding. The second partition 201 is installed in the second reservoir body 21 by welding or integrally formed with the second reservoir body 21. The second liquid inlet chamber 202 is integrally formed with a boss 211. The liquid pump chamber 204 is integrally formed and located on the back of the boss 211. The second liquid inlet 205 is formed on the boss 211. The inner side of the liquid pump cover 213 is formed with a protruding portion 231. The protruding portion 231 is matched with the liquid pump chamber 204. The protruding portion 231 is inserted in the liquid pump chamber 204. The surface of the protruding portion 231 is formed with a recess 208. The liquid pump 51 is inserted and fixed in the recess 208.

Two ends of the radiating pipes 30 communicate with the first reservoir 10 and the second reservoir 20, respectively. Radiating fins 60 are provided on the radiating pipes 30. Specifically, some of the radiating pipes 30 are connected between the first liquid outlet chamber 103 and the second liquid inlet chamber 202, and the others of the radiating pipes 30 are connected between the first liquid inlet chamber 102 and the second liquid outlet chamber 203. The corresponding ends of the radiating pipes 30 are hermetically installed in the corresponding first installation grooves 106. The corresponding ends of the radiating pipes 30 are hermetically installed in the corresponding second installation grooves 207. The radiating pipes 30 are arranged in a row. In addition, two fan brackets 70 are connected between the first reservoir 10 and the second reservoir 20. The two fan brackets 70 are arranged on the left and right sides of the liquid-cooling radiator. The radiating pipes 30 are located between the two fan brackets 70. The two fan brackets 70 are configured to install and fix cooling fans, so as to accelerate the heat dissipation efficiency.

The working principle of this embodiment is described in detail as follows:

When in use, a heat-generating electronic device is attached to the thermally conductive copper sheet 41, and the two fan brackets 70 are installed with cooling fans. The heat generated when the heat-generating electronic device is working is conducted to the thermally conductive copper sheet 41. At this time, the liquid pump 51 and the cooling fans can be turned on to dissipate heat and cool down the thermally conductive copper sheet 41. Specifically, after the liquid pump 51 is turned on, the cooling liquid (such as water, etc.) in the product starts to circulate in the flow path. The cooling liquid with a lower temperature enters the thermally conductive copper sheet 41 from the first liquid inlet chamber 102 through the first liquid inlet 104, and then the cooling liquid passes through the fins 411 on the thermally conductive copper sheet 41 to absorb the heat on the thermally conductive copper sheet 41. After the cooling liquid absorbs heat, the temperature of the cooling liquid rises and the cooling liquid enters the first liquid outlet chamber 103 from the first liquid outlet 105. Then, the cooling liquid flows into the second liquid inlet chamber 202 from some of the radiating pipes 30 in the form of multiple channels. When the cooling liquid flows through the radiating pipes 30 for the first time, some heat is absorbed. The heat on the radiating pipes 30 is dissipated by the cooling fans in time. Then, the cooling liquid enters the liquid pump chamber 204 through the second liquid inlet 205. In the liquid pump chamber 204, the cooling liquid enters the second liquid outlet chamber 203 through the second liquid outlet 206 after being pressurized. Then, the cooling liquid flows back into the first liquid inlet chamber 102 from the others of the radiating pipes 30 in the form of multiple channels. When the cooling liquid flows through the radiating pipes 30 for the second time, heat is absorbed again, so that the temperature of the cooling liquid is further reduced. The cooled cooling liquid passes through the first liquid inlet 104 and enters the thermally conductive copper sheet 41 again to absorb heat. This cycle repeats and continuously absorbs the heat on the thermally conductive copper sheet 41 to ensure that the heat-generating electronic device works normally and will not be abnormal due to excessive temperature.

Figure 6:
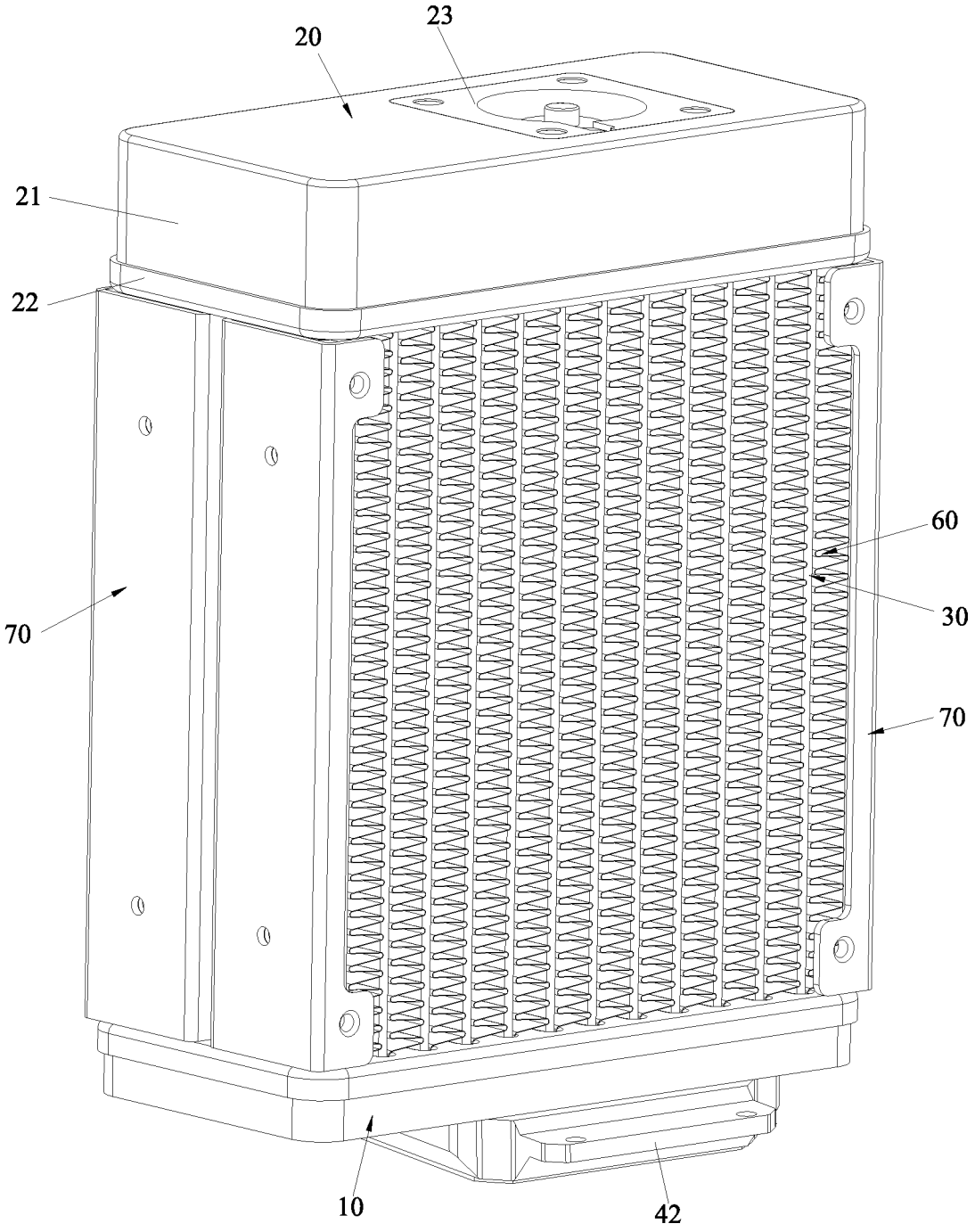
FIG. 6 is a perspective view according to a second embodiment of the present invention.
Figure 7:
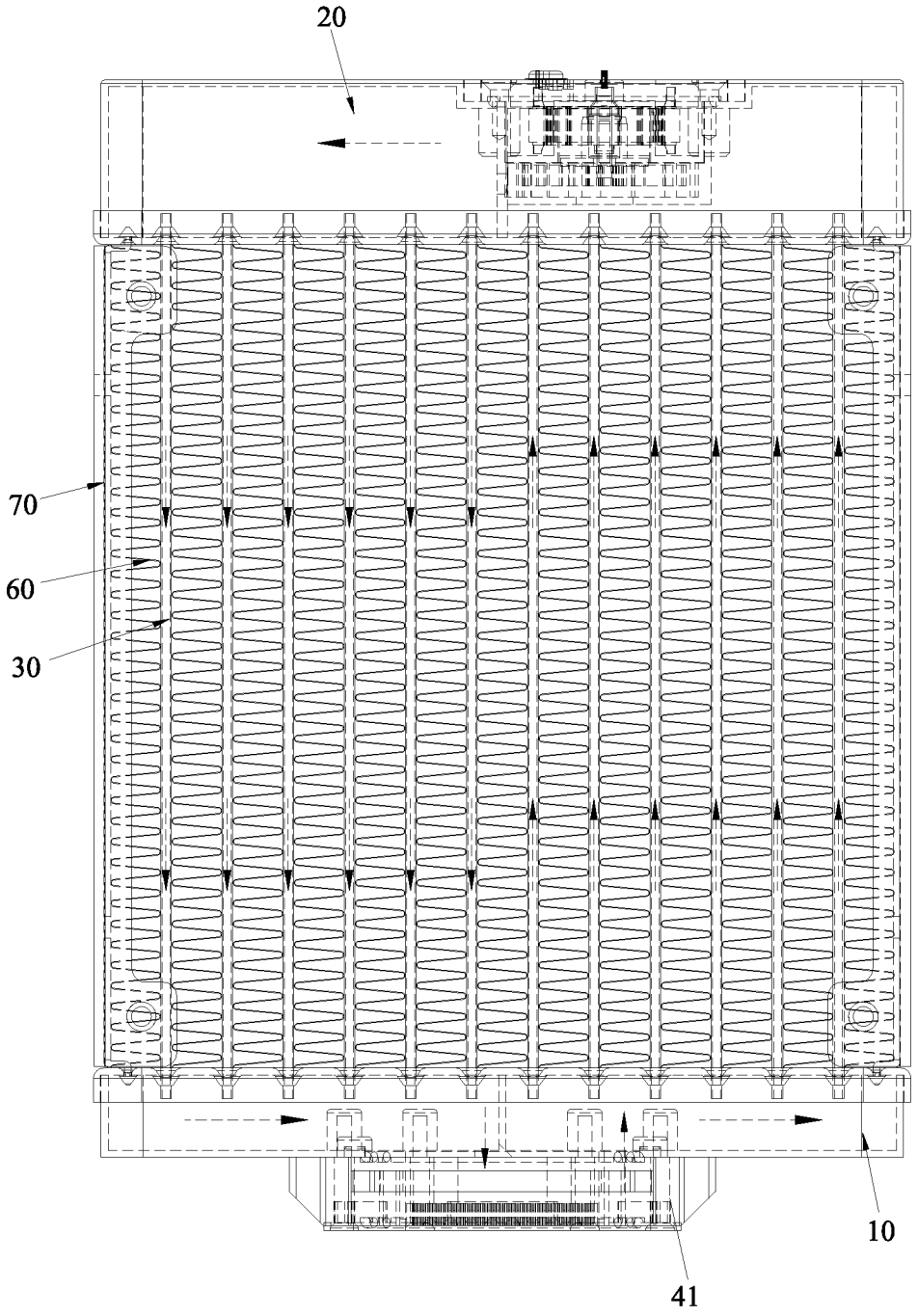
FIG. 7 is a front view according to the second embodiment of the present invention.
Figure 8:
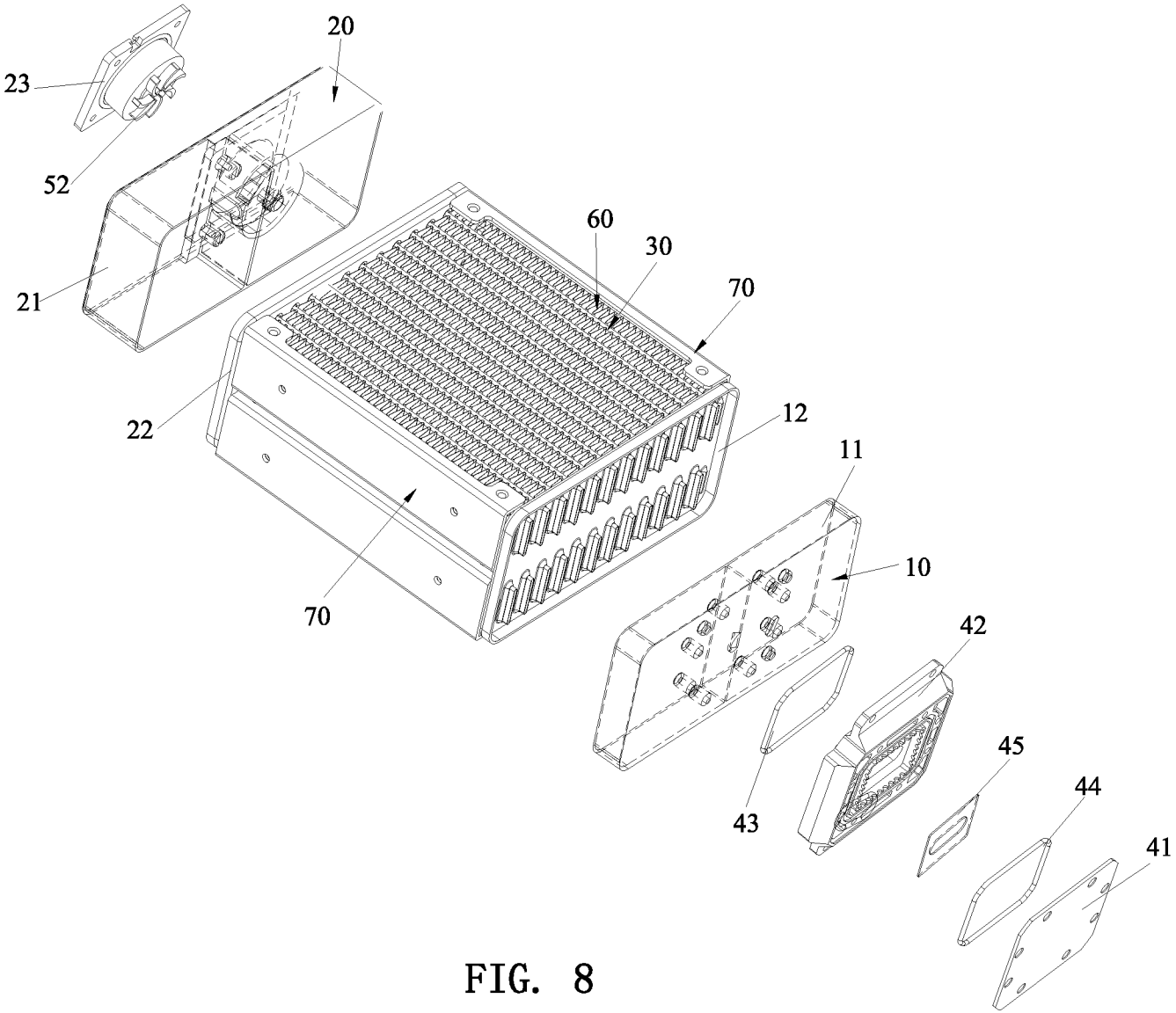
FIG. 8 is an exploded view according to the second embodiment of the present invention.
Figure 9:
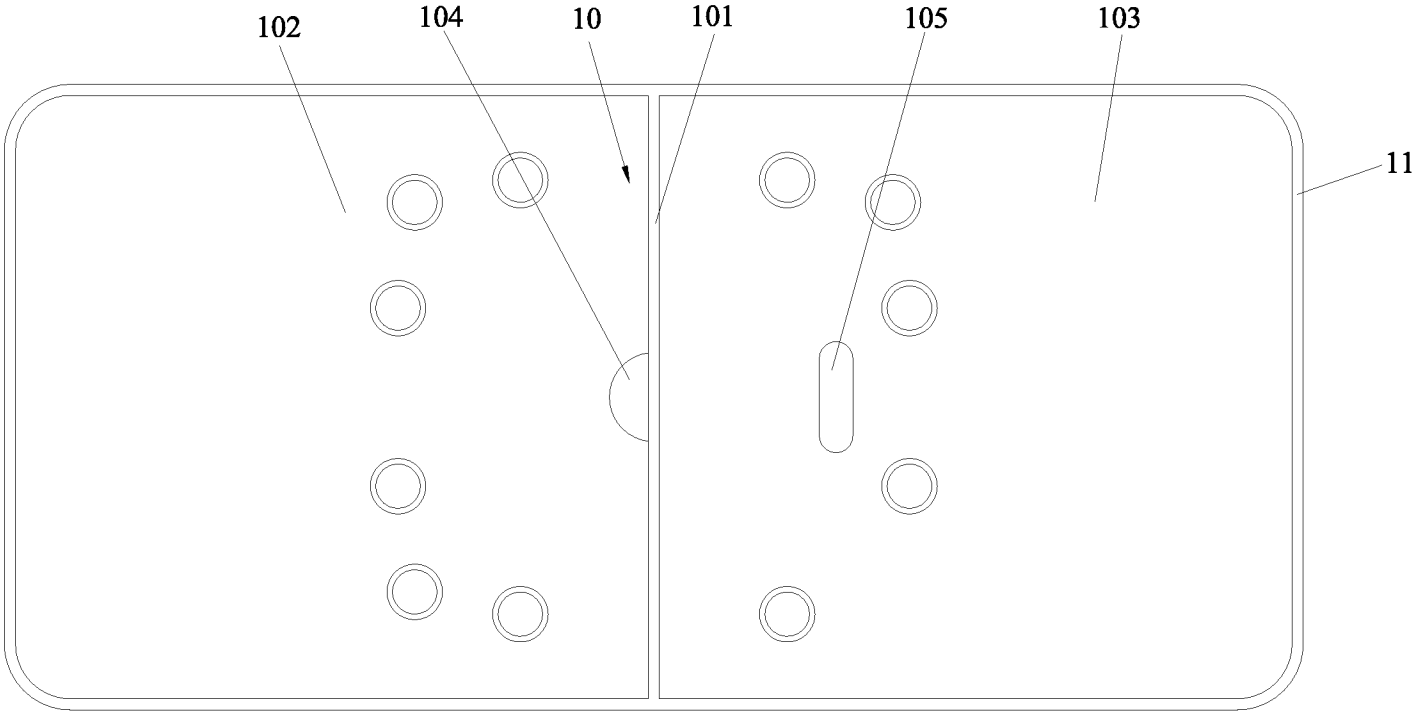
FIG. 9 is a front view of the first reservoir according to the second embodiment of the present invention.
Figure 10:
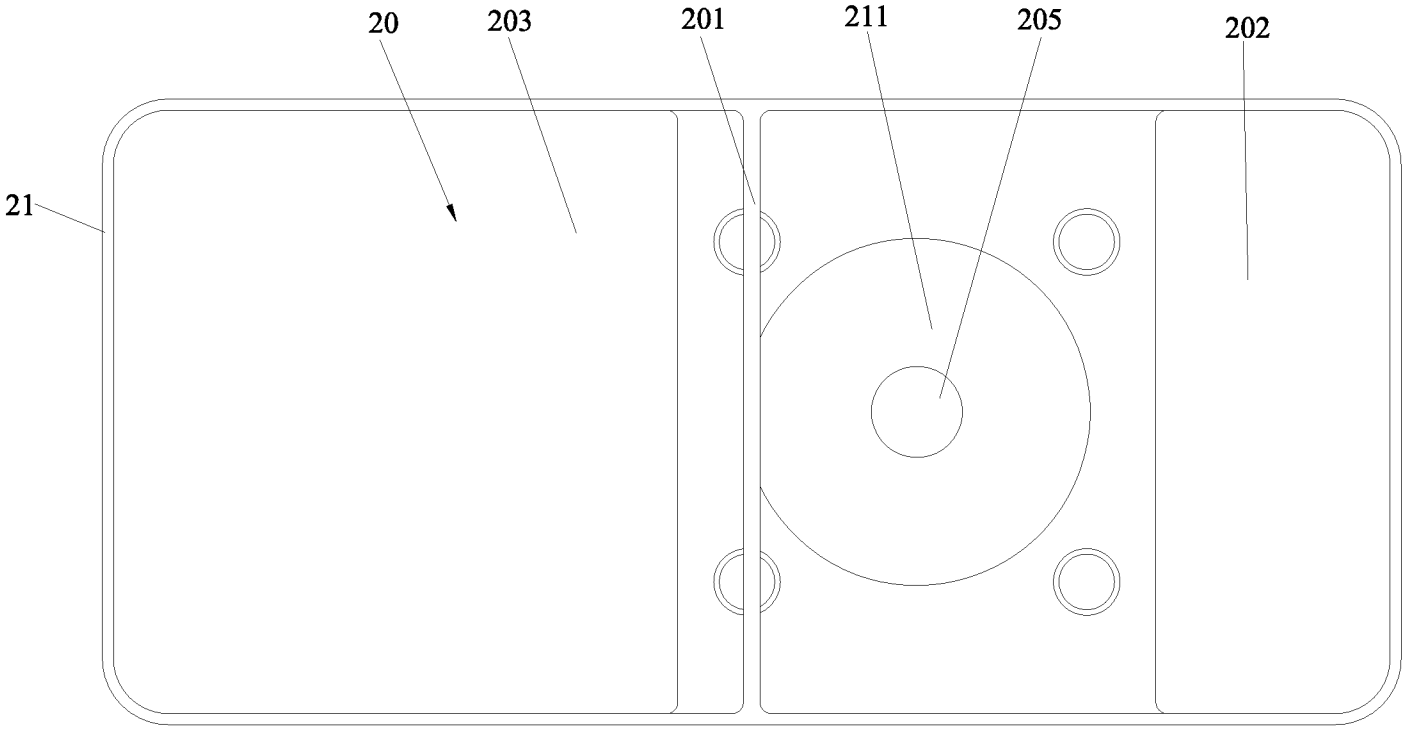
FIG. 10 is a front view of the second reservoir according to the second embodiment of the present invention.

FIGS. 6-10 show the specific structure of a second embodiment of the present invention. The specific structure of the second embodiment is substantially similar to the specific structure of the first embodiment with the exceptions described hereinafter.

In this embodiment, the radiating pipes 30 are arranged in front and rear two rows, so that the product has a larger cooling liquid capacity, can absorb more heat, has a better heat dissipation effect, and meets the use requirements of high-power heat-generating electronic devices.

What is claimed is:

1. An integrated liquid-cooling radiator, comprising a first reservoir, a second reservoir and a plurality of radiating pipes; two ends of the radiating pipes communicating with the first reservoir and the second reservoir respectively, radiating fins being provided on the radiating pipes;

the first reservoir being made of a heat-dissipating metal material, a first partition being provided in the first reservoir to divide an inside of the first reservoir into a first liquid inlet chamber and a first liquid outlet chamber, a bottom of the first reservoir being formed with a first liquid inlet communicating with the first liquid inlet chamber and a first liquid outlet communicating with the first liquid outlet chamber; the bottom of the first reservoir being provided with a thermally conductive copper sheet, a liquid inlet end of the thermally conductive copper sheet being in communication with the first liquid inlet, a liquid outlet end of the thermally conductive copper sheet being in communication with the first liquid outlet;

the second reservoir being made of a heat-dissipating metal material, a second partition being provided in the second reservoir to divide an inside of the second reservoir into a second liquid inlet chamber and a second liquid outlet chamber, the second liquid inlet chamber being provided with a liquid pump chamber, the liquid pump chamber being provided with a second liquid inlet communicating with the second liquid inlet chamber and a second liquid outlet communicating with the second liquid outlet chamber, a liquid pump being provided in the liquid pump chamber;

some of the radiating pipes being connected between the first liquid outlet chamber and the second liquid inlet chamber, the others of the radiating pipes being connected between the first liquid inlet chamber and the second liquid outlet chamber.

2. The integrated liquid-cooling radiator as claimed in claim 1, wherein the first reservoir includes a first reservoir body and a first reservoir cover; the first partition is formed in the first reservoir body, the first liquid inlet and the first liquid outlet are formed on a bottom of the first reservoir body; the first reservoir cover is hermetically fixed to the first reservoir body, the first reservoir cover is provided with a plurality of first installation grooves, some of the first installation grooves communicate with the first liquid inlet chamber, the others of the first installation grooves communicate with the first liquid outlet chamber, and the corresponding ends of the radiating pipes are hermetically installed in the corresponding first installation grooves, respectively.

3. The integrated liquid-cooling radiator as claimed in claim 2, wherein the thermally conductive copper sheet is fixed to the bottom of the first reservoir body through a fixing seat, a first sealing gasket is sandwiched between an inner peripheral edge of the fixing seat and the first reservoir body, the thermally conductive copper sheet is fixed to a bottom of the fixing seat, a second sealing gasket is sandwiched between an inner peripheral edge of the thermally conductive copper sheet and the fixing seat, fins provided on an inner side of the thermally conductive copper sheet are covered with a partitioning film, the partitioning film is clamped between the fixing seat and the thermally conductive copper sheet, the partitioning film has a slot, and the slot is aligned with and communicates with the first liquid inlet.

4. The integrated liquid-cooling radiator as claimed in claim 2, wherein the first reservoir body and the first reservoir cover are made of copper or aluminum, the first reservoir cover is hermetically fixed to the first reservoir body by welding, and the first partition is installed in the first reservoir body by welding or integrally formed with the first reservoir body.

5. The integrated liquid-cooling radiator as claimed in claim 1, wherein the second reservoir includes a second reservoir body, a second reservoir cover, and a liquid pump cover; the second partition is formed in the second reservoir body; the second reservoir cover is hermetically fixed to the second reservoir body, the second reservoir cover is provided with a plurality of second installation grooves, some of the second installation grooves communicate with the second liquid inlet chamber, the others of the second installation grooves communicate with the second liquid outlet chamber, the corresponding ends of the radiating pipes are hermetically installed in the corresponding second installation grooves; the liquid pump cover is hermetically fixed to the second reservoir body and configured to seal an opening of the liquid pump chamber, the liquid pump is fixed to an inner side of the liquid pump cover, an impeller is connected to an output shaft of the liquid pump, the impeller is located in the liquid pump chamber and is driven to rotate by the liquid pump.

6. The integrated liquid-cooling radiator as claimed in claim 5, wherein the second liquid inlet chamber is integrally formed with a boss, the liquid pump chamber is integrally formed and located on a back of the boss, and the second liquid inlet is formed on the boss.

7. The integrated liquid-cooling radiator as claimed in claim 5, wherein the second reservoir body and the second reservoir cover are made of copper or aluminum, the second reservoir cover is hermetically fixed to the second reservoir body by welding, and the second partition is installed in the second reservoir body by welding or integrally formed with the second reservoir body.

8. The integrated liquid-cooling radiator as claimed in claim 5, wherein an inner side of the liquid pump cover is formed with a protruding portion, the protruding portion is matched with the liquid pump chamber, the protruding portion is inserted in the liquid pump chamber, a surface of the protruding portion is formed with a recess, and the liquid pump is inserted and fixed in the recess.

9. The integrated liquid-cooling radiator as claimed in claim 1, wherein two fan brackets are connected between the first reservoir and the second reservoir, the two fan brackets are arranged on left and right sides of the liquid-cooling radiator, and the radiating pipes are located between the two fan brackets.

10. The integrated liquid-cooling radiator as claimed in claim 1, wherein the radiating pipes are arranged in one row or in front and rear two rows.

* * * * *